United States Patent [19]

Walls

[11] 3,942,209

[45] Mar. 9, 1976

[54] PAINT APPLICATOR

[76] Inventor: David L. Walls, 1204 Sheridan Road, Bremerton, Wash. 98310

[22] Filed: Sept. 13, 1974

[21] Appl. No.: 505,675

Related U.S. Application Data

[63] Continuation of Ser. No. 357,698, May 7, 1973, abandoned.

[52] U.S. Cl. ..... 15/118; 15/230.11; 15/248 A

[51] Int. Cl.[2] ..... B05C 17/02

[58] Field of Search ..... 15/27, 114, 118, 230.11, 15/248 A; 401/22, 208, 218–220

[56] References Cited

UNITED STATES PATENTS

| | | | |
|---|---|---|---|
| 69,901 | 10/1867 | Davis | 401/22 X |
| 3,175,242 | 3/1965 | Kamondy et al. | 401/193 X |
| 3,346,899 | 10/1967 | Murphy | 15/118 |
| 3,378,872 | 4/1968 | Frontera et al. | 15/248 A |
| 3,457,582 | 7/1969 | Fisher | 15/248 A |
| 3,591,299 | 7/1971 | Pharris | 401/118 |

FOREIGN PATENTS OR APPLICATIONS

| | | | |
|---|---|---|---|
| 887,294 | 1/1962 | United Kingdom | 15/248 A |
| 821,475 | 11/1951 | Germany | 401/218 |

*Primary Examiner*—Daniel Blum

[57] ABSTRACT

A roller type paint applicator comprises a roller mounted on a shaft for free rotation, the shaft being extended to provide a handle extending normal to the roller axis. An elongated housing encloses the entire roller except for an opening on one side through which the roller projects a sufficient distance for engagement with a surface to be painted. Paint wiping strips are mounted on the housing along both longitudinal edges and have long nap cloth for engagement with the surface to be painted along both longitudinal sides of the opening. The edges prevent painting of adjacent walls and afford close and effective painting of a wall surface up to corners and wall intersections.

7 Claims, 4 Drawing Figures

PAINT APPLICATOR

This is a continuation of application Ser. No. 357,698, filed May 7, 1973, now abandoned.

This invention relates to paint applicators and particularly to an improved roller applicator of the shielded type for more effectively painting surfaces of walls and ceilings adjacent the corners thereof.

In the past many arrangements have been provided for shielding roller type paint applicators for minimizing drip and spray. These arrangements have included adjustable shields and various forms of auxiliary brushes therein. The arrangements have proved suitable for many purposes, however, they have not been entirely effective for all applications including that of painting a wall or ceiling surface completely up to another wall without a likelihood of applying paint to the other wall while also preventing the unwanted escape of paint from the applicator. Accordingly, it is an object of my present invention to provide a shielded roller type paint applicator including an improved arrangement for effectively shielding the roller while affording complete coverage of a wall along an area adjoining another wall.

It is another object of my invention to provide a roller type paint applicator including an improved arrangement for preventing the undesirable escape of paint during its operation.

It is another object of my invention to provide a fully shielded paint applicator of the roller type including an improved arrangement for facilitating the application of paint to the roller.

Briefly, in carrying out the objects of my invention in one embodiment thereof, a paint applicator of the roller type having a handle formed as a continuation of the roller shaft and including a section extending radially outwardly with respect to the roller and centrally thereof is provided with a shield or guard in the form of a cylindrical housing enclosing and spaced radially from the roller. The housing is provided with a bottom opening through which the roller projects a sufficient distance for engagement with the surface to be painted. Along the longitudinal edges of the housing, and on either side of the roller, there are provided paint spreading members which are straight rectangular strips having long napped cloth strips on their wall engaging faces. These strips make it possible to work the roller up to an adjacent wall and to spread the paint to the edge of a wall surface without applying any paint to the adjacent wall. The roller is thus enclosed completely on both longitudinal sides during use and further the two strips one on either side of the roller maintain the housing in the same position with respect to the surface to be painted regardless of the position of the handle. When it is desired to apply paint to the roller the housing may be moved away from the roller against the pressure of biasing springs so that the two straight coating members attached to the housing are lifted out of contact with the paint supply. For this purpose the roller is spring biased toward its position within the housing and the housing is moved away from the roller by holding the handle and lifting the housing while the roller is moved over the paint supply.

The features of novelty which characterize my invention are pointed out with particularity in the claims annexed to and forming a part of this specification. My invention itself, however, both as to its organization and manner of operation, together with further objects and advantages thereof, may best be understood by reference to the following description taken in connection with the accompanying drawings in which:

Figure 1:
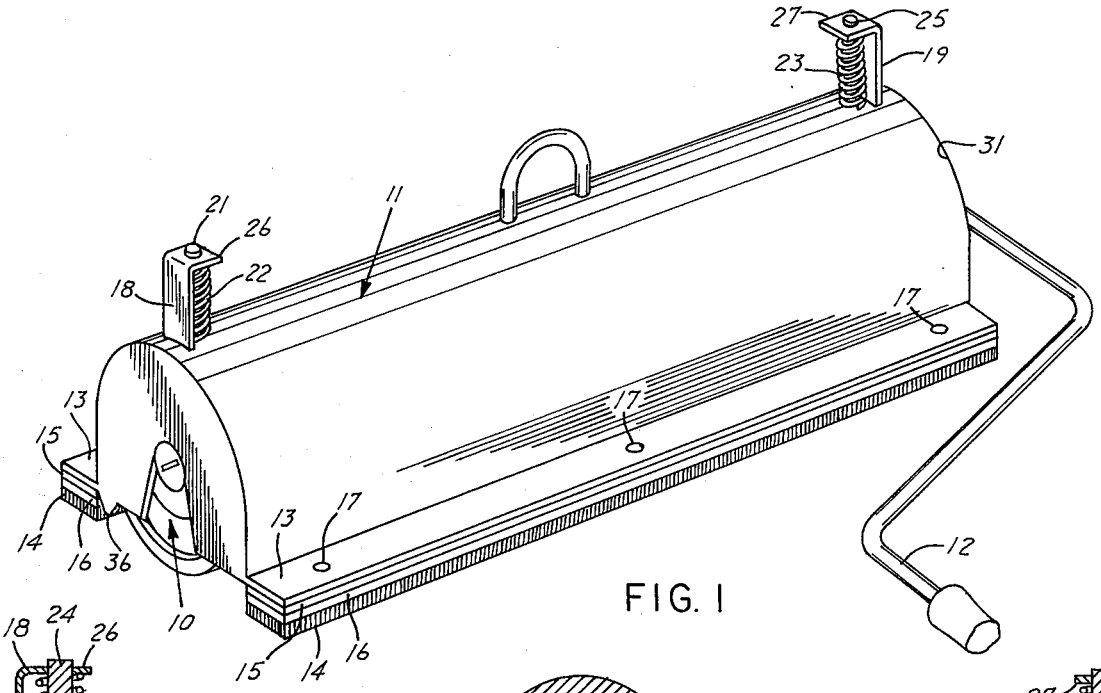
FIG. 1 is an isometric view of a paint applicator embodying my invention.
Figure 2:
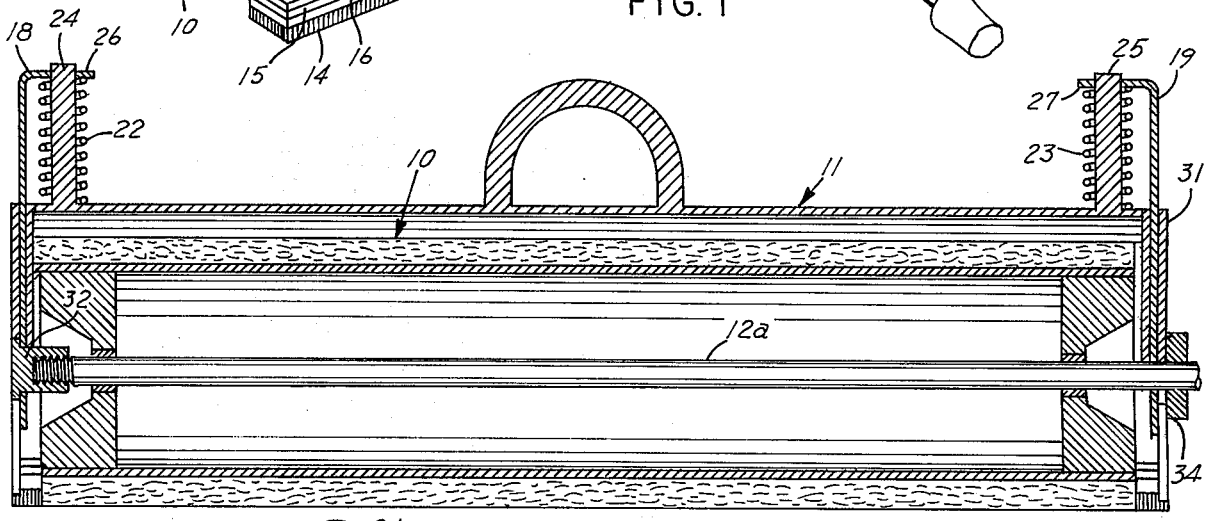
FIG. 2 is a longitudinal sectional elevation view through the center of the applicator of FIG. 1.

Referring now to the drawing, the paint applicator illustrated in FIG. 1 comprises a roller 10 mounted for free rotation within a housing or shield 11 on a shaft comprising a straight extension of a handle 12 indicated at 12a in FIG. 2. The handle 12 has its main portion extending outwardly from the central portion of the housing and normal to the roller axis, and the shaft position is formed on an offset extending laterally of the main portion and then forwardly to the roller axis. The longitudinal sides of the housing 11 are straight and flat and are provided with flanges 13 of elongate rectangular configuration which terminate flush with the ends of the housing. Paint spreading elements comprising long napped cloth strips 14 mounted on rigid strips 15 by intermediate strips 16 of highly flexible easily compressed foamed plastic material are secured to the flanges by detachable rubber-like knobs or buttons 17 which pass through holes in the flanges 13. These spreading elements are readily detachable and replaceable and are readily cleaned. The paint applying side of the housing is thus of rectangular configuration and may be brought closely up to adjoining walls and into corners.

Figure 3:
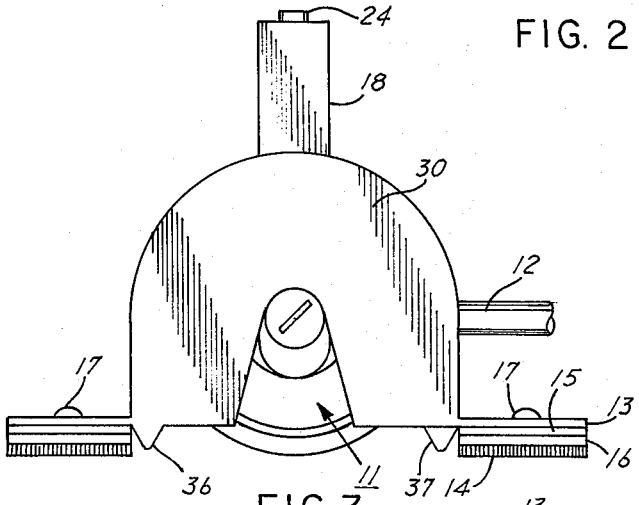
FIG. 3 is a left end view of the applicator of FIG. 1.

As shown in FIGS. 2 and 3, the housing 11 is mounted so that it may be moved away from the roller 10 to facilitate the application of paint to the roller. The shaft **12*a* is mounted in end slides 18 and 19 which are urged upwardly by springs 22 and 23 mounted about posts 24 and 25 formed integrally with the housing. The springs 22 and 23 press against inturned ends 26 and 27, respectively, of the slides 18 and 19. The slides are movable in vertical guides formed in the end walls 30 and 31 respectively, of the housing. The shaft 12a is pivotally mounted in the lower ends of the slides, the left hand end of the shaft being threaded to receive a fitting 32 which holds the roller on the shaft and is rotatably mounted in the slide 18. It will thus be seen that the roller 10 is biased by the springs toward its position in the housing 11, slots are provided in the end walls to afford movement of the shaft 12*a* and fitting 32, the slot for the fitting 32 being shown in FIGS. 3 and 4.**

Figure 4:
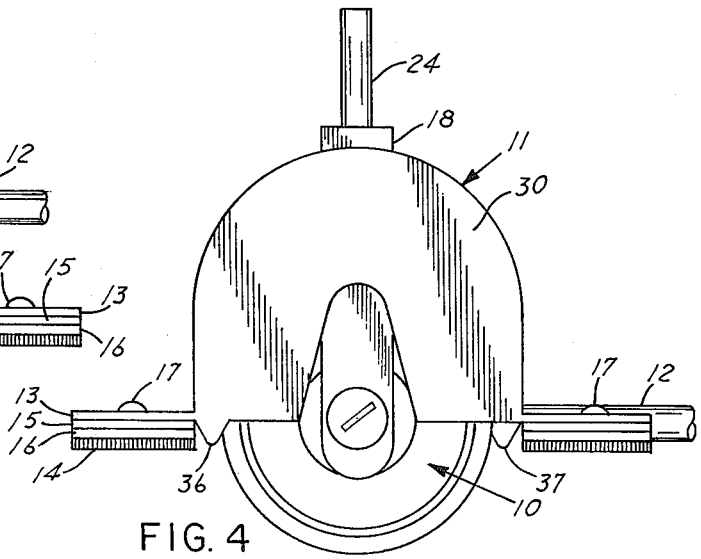
FIG. 4 is a view similar to FIG. 3 showing the roller in its position for receiving paint.

The housing may be lifted from the roller by holding the roller against a paint supply surface and using a grip of loop 33 to lift the housing from the roller. The roller may then be rolled back and forth over the paint supply surface to receive a supply for further painting. The position of the housing 11 during the application of paint to the roller is shown in FIG. 4 where it can be seen that the paint spreading elements are lifted from the level of the bottom of the roller so that they may be kept away from the paint supply.

When the roller is assembled within the housing as shown in FIG. 2, the position of the shaft **12*a* is limited by a stop disc 34 which is welded or otherwise secured to the shaft and which has a flat inner face bearing on the flat end wall 31 of the housing. The fitting 32 thus locks the roller and housing between it and the stop disc 34. The outer side of the fitting 32 lies flush with the outer face of the end wall 30 of the housing and this wall thus presents a flat face which may be brought close to an adjacent wall at the corner of a room or the like. The handle 12 may be used in any position and the flat end wall 30** may be made to lie along an adjacent wall at either side of a wall to be painted, and the paint spreading strips may be used to finish the painting of a wall up to an adjacent wall either in front of the roller or on either side.

The long napped cloth which is employed is selected for its flexibility and for the soft character of the long nap which does not tend to throw the paint during use in the manner experienced with many bristle brushes.

As shown in FIG. 3, the cloth portions of the spreader elements lie substantially in the plane of the outer wall engaging side of the roller and, thus, the spreaders maintain the housing in the same position with regard to the surface to be painted regardless of the position of the applicator. The roller of this invention may thus be used equally well on vertical walls and on ceilings. The spreader strips make it possible to paint a surface up to an intersecting wall without spreading or splashing paint onto each wall. The paint used on the spreader elements is picked up from the surface covered by the roller and is not supplied originally to the spreader; however, if desired a spreader may be supplied with paint from the source when used for finishing the edges of covered surfaces. Two generally triangular thin skids 36 and 37 are provided on diagonally opposite corners of the housing to limit the movement of the housing toward the surface being painted. These skids ride on the surface so that the nap of the cloth 14 is not compressed against the base of the spreader elements.

The paint applying device of my invention may be used with any desired length of handle and is equally effective in all positions of the handle. This greatly facilitates the effective and rapid painting of wall surfaces.

While I have disclosed my invention in connection with a single embodiment thereof, various other applications and arrangements will occur to those skilled in the art. Therefore I do not desire my invention to be limited to the details disclosed and I intend by the accompanying claims to cover all modifications which fall within the spirit and scope of my invention.

I claim:

1. A paint applicator comprising:

a paint applying roller, a shaft for said roller, said roller being freely rotatable about the axis of said shaft, a handle rigidly connected with said shaft for maneuvering ing said roller, an elongated housing pivotally mounted about said axis and enclosing said roller and having its inner walls spaced from said roller, said housing being open on one side along a plane parallel to said axis and said roller and having a radius greater than the distance from said axis to said plane whereby said roller extends outwardly beyond said opening for engagement with a wall surface to be painted, a pair of flat straight paint spreading elements one along each longitudinal edge of said opening and having paint smoothing surfaces lying in substantial alignment with the outer face of said roller projecting through said opening whereby said housing is effectively closed along both longitudinal sides and is maintained in substantially the same position with respect to the wall to be painted throughout the engagement of said roller with the wall regardless of the angular position of said handle with respect to said housing, and means affording movement of said housing laterally away from said shaft for affording movement of said roller outwardly of said housing and away from said elements for facilitating the application of paint to said roller.

2. A paint applicator as set forth in claim 1 including means for biasing said roller toward its position within said housing.

3. A paint applicator as set forth in claim 1 wherein said means for affording movement of said housing comprises a pair of slides mounted on said housing adjacent the respective ends thereof and being connected to said shafts at their lower ends and affording free rotation of said shaft therein, said slides being slidable downwardly for moving said roller outwardly of said housing along a path normal to the plane of said opening and spring means between said slides and said housing for biasing said slides upwardly to hold said roller normally in its position within said housing.

4. A paint applicator as set forth in claim 3 wherein said handle lies outwardly of said housing along a line normal thereto, and including a pull grip on the top of said housing centrally of the length of said housing for facilitating the lifting of said housing from said roller during application of paint to said roller.

5. A paint applicator as set forth in claim 3 wherein each of said slides projects above the top of said housing and has a laterally extending end portion, guide posts mounted on top of said housing and slidably engaging respective ones of said end portions, and wherein said spring means includes coil springs about said posts between said housing and said end portions.

6. A paint applicator comprising:

a paint applying roller;

a shaft for said roller, said roller being freely rotatable about the axis of said shaft;

a handle rigidly connected with said shaft for maneuvering said roller;

an elongated housing pivotally mounted about said axis and enclosing said roller and having its inner walls spaced from said roller, said housing being open on one side along a plane parallel to said axis, said roller having a radius greater than the distance from said axis to said plane whereby said roller extends outwardly beyond said opening for engagement with a wall surface to be painted;

a pair of flat straight paint spreading elements one along each longitudinal edge of said opening and each having its cuter edge extending beyond the respective side wall of said housing, and having their flat paint smoothing surfaces lying in the same plane and arranged for alignment with the outer face of said roller projecting through said opening whereby when said applicator is positioned against a surface to be painted said housing is fully and effectively closed along both longitudinal sides and is maintained in substantially the same position with respect to the wall to be painted throughout the engagement of said roller with the wall regardless of the angular position of said handle with respect to said housing and the direction of movement of said roller;

said spreading elements being soft and without tendency to throw paint during use and the outer edge portions of said spreader elements affording application of paint to a wall surface up to an adjacent wall at a corner between walls;

each of said paint spreading elements comprising a strip of long napped cloth and a rigid attaching element;

said applicator including flanges on said housing extending outwardly from said opening of said housing and in the same plane and means for detachably securing said spreader elements to said flanges.

7. A paint applicator comprising:

a paint applying roller;

a shaft for said roller, said roller being freely rotatable about the axis of said shaft;

a handle rigidly connected with said shaft for maneuvering said roller;

an elongated housing pivotally mounted about said axis and enclosing said roller and having its inner walls spaced from said roller, said housing being open on one side along a plane parallel to said axis, said roller having a radius greater than the distance from said axis to said plane whereby said roller extends outwardly beyond said opening for engagement with a a pair of flat straight paint spreading elements one along each longitudinal edge of said opening and each having its outer edge extending beyond the respective side wall of said housing, and having their flat paint smoothing surfaces lying in the same plane and arranged for alignment with the outer face of said roller projecting through said opening whereby when said applicator is positioned against a surface to be painted said housing is fully and effectively closed along both longitudinal sides and is maintained in substantially the same position with respect to the wall to be painted throughout the engagement of said roller with the wall regardless of the angular position of said handle with respect to said housing and the direction of movement of said roller, said spreading elements being soft and without tendency to throw paint during use and the outer edge portions of said spreader elements affording application of paint to a wall surface up to an adjacent wall at a corner between walls;

each of said paint spreading elements comprising a strip of long napped cloth and a rigid attaching element;

said applicator including skids on said housing positioned for engagement with the surface to be painted after the nap of the cloth has been engaged therewith and been pressed slightly against the surface for preventing crushing of the nap.

* * * * *